US005898148A

United States Patent [19]

Zacharias et al.

[11] Patent Number: 5,898,148

[45] Date of Patent: Apr. 27, 1999

[54] COIL SHAPED TERMINAL FOR AN ELECTRODYNAMICALLY OPERATED CIRCUIT BREAKER

[75] Inventors: Albert Zacharias, Neuwied; Wolfgang Erven, Hilden, both of Germany

[73] Assignee: Klöckner Moeller GmbH, Bonn, Germany

[21] Appl. No.: 09/005,295

[22] Filed: Jan. 9, 1998

[30] Foreign Application Priority Data

Jan. 11, 1997 [DE] Germany ..... 197 00 758

[51] Int. Cl.[6] ..... H01H 33/18; H01H 9/44

[52] U.S. Cl. ..... 218/22; 218/30; 335/16

[58] Field of Search ..... 218/22, 24, 26, 218/27, 28, 30, 31, 32, 33; 335/16, 147, 195

[56] References Cited

U.S. PATENT DOCUMENTS 3,555,471 1/1971 Mitskevich et al. ..... 335/16
3,593,227 7/1971 Mitskevich .
3,921,109 11/1975 Hodgson .
5,313,180 5/1994 Vial et al. .
5,424,699 6/1995 Globe ..... 335/16

FOREIGN PATENT DOCUMENTS 0560696 9/1993 European Pat. Off. .
2450424 3/1976 Germany .

*Primary Examiner*—Lincoln Donovan
*Attorney, Agent, or Firm*—Nils H. Ljungman and Associates

[57] ABSTRACT

A switch has at least one fixed and one moving contact located on a contact arm. The fixed contact is connected to a loop-shaped conductor segment, such that when current flows through the conductor segment, there is an electrodynamic magnetic force which acts on the contact arm. The force, above a specified current intensity, results in an opening movement of the contact arm. To open the moving contact more rapidly and in a simple manner the loop-shaped conductor segment is realized so that it is wound in a coil shape, and consists of at least two turns, and that the coil axis of the coil segment runs perpendicular to the longitudinal axis of the contact arm.

6 Claims, 2 Drawing Sheets

COIL SHAPED TERMINAL FOR AN ELECTRODYNAMICALLY OPERATED CIRCUIT BREAKER

BACKGROUND OF THE INVENTION

1. Field of the Invention

The present invention relates to a switch which has at least one fixed or stationary contact and one moving contact located on a contact arm or wiper. The fixed contact is connected to a loop-shaped conductor segment, such that when current flows through the conductor segment, there is an electrodynamic magnetic force which acts on the contact arm. The force, above a specified current intensity, results in an opening movement of the contact arm against the force of a contact compression spring.

2. Background Information

A switch of this type is described, for example, in European Patent No. 0 560 696 A1. On this known switch, the fixed contact is connected to a conductor segment which is bent in the shape of a loop. The loop-shaped conductor segment is thereby bent so that when current flowing through the conductor segment exerts a magnetic force on the contact arm, the current strength above a specified level, the short circuit current, results in an opening movement of the contact arm and thus also of the moving contact.

OBJECT OF THE INVENTION

The object of the present invention is to achieve in a simple manner a more rapid opening of the moving contact than is possible on comparable known switches.

SUMMARY OF THE INVENTION

The present invention teaches that this object can be accomplished by having the loop-shaped conductor segment realized so that it is wound in a coil shape, and having the loop-shaped conductor segment contain at least two turns. The coil axis of the coil segment can then run perpendicular to the longitudinal axis of the contact arm.

The present invention is essentially based on the teaching that the loop-shaped conductor segment is realized so that the segment is wound in a coil shape and consists of at least two turns, whereby the coil axis of the conductor segment runs perpendicular to the longitudinal axis of the contact arm.

To obtain a stable and compact arrangement of the loop-shaped conductor segment, the invention teaches that in one particularly advantageous embodiment, the respective first turn of the conductor segment has a central recess which extends in the direction of the longitudinal axis of the conductor segment, in which recess is located the second turn which carries the fixed contact.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintain that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

Additional details and advantages of the invention are described below, with reference to the exemplary embodiments illustrated he accompanying figures, in which.

DESCRIPTION OF THE PREFERRED EMBODIMENT

Figure 1:
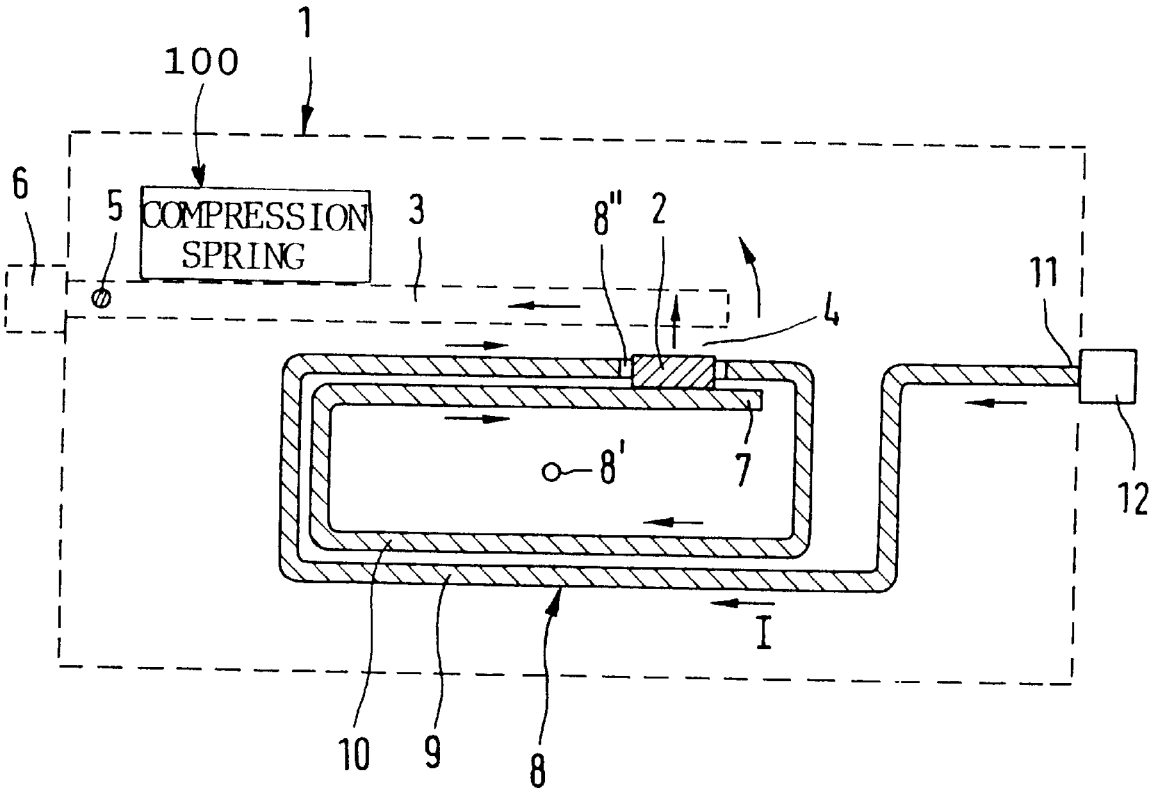
FIG. 1 is a longitudinal section through a first embodiment of a loop-shaped conductor segment with two turns arranged in the form of a spiral.

FIG. 1 is a schematic illustration of a current-limiting power circuit breaker 1, which power circuit breaker 1 has a fixed contact 2 and a moving contact 4 located on a contact arm 3, which contact arm 3 is illustrated in broken lines. The contact arm 3 can be pivoted around an axis 5 and is connected on the end of the contact arm 3 farther from the moving contact 4 to a first connection terminal 6.

The fixed contact 2 is fastened in the vicinity of the first end 7 of a conductor segment 8, which conductor segment 8 is bent in a loop shape. The conductor segment 8 is wound in the shape of a coil and consists of two turns 9, 10, whereby, when seen in a side view, the coil axis 8' of the conductor segment 8 runs perpendicular to the plane of the figure.

The fixed contact 2 projects through a recess 8" of the outer or first turn 9. The second end 11 of the conductor segment 8 is connected to a second connection terminal 12. By the two connection terminals 6 and 12, the power circuit breaker 1 is switched into one phase of a power system which is not shown to simplify the drawing.

In one embodiment of the present invention, the power circuit breaker 1 can be connected to an alternative part of the power system by the two connection terminals 6 and 12.

When a load current I flows through the corresponding network phase and thus through the loop-shaped conductor segment 8, via the two contacts 2, 4 and via the contact arm 3, an electrodynamic magnetic force is constantly exerted on the contact arm 3 as a result of the current flowing in the conductor segment 8. When this magnetic force becomes greater than the contact force, the moving contact 4 automatically begins to open and the contact arm 3 pivots around the axis 5 against the force of a spring represented by box 100 in FIG. 1.

Figure 2:
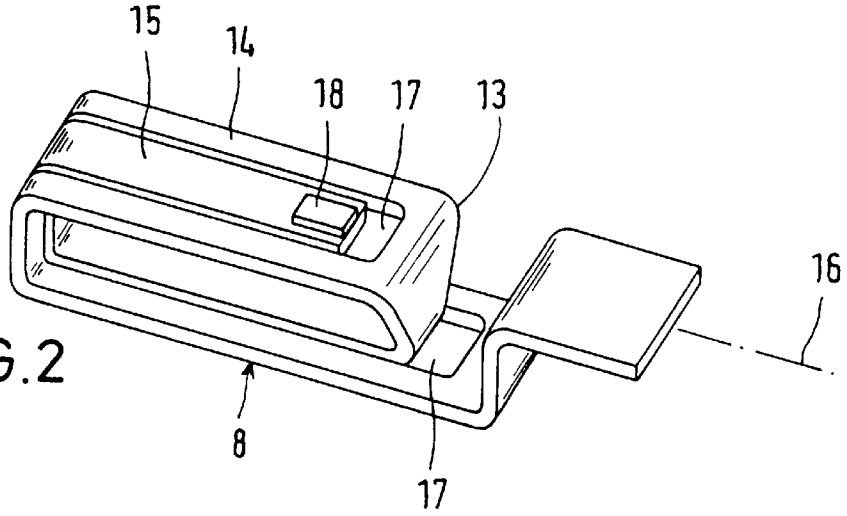
FIG. 2 is a view in perspective of a second embodiment of a conductor segment with two turns, whereby the second turn is located in a recess in the first turn.
Figure 3:
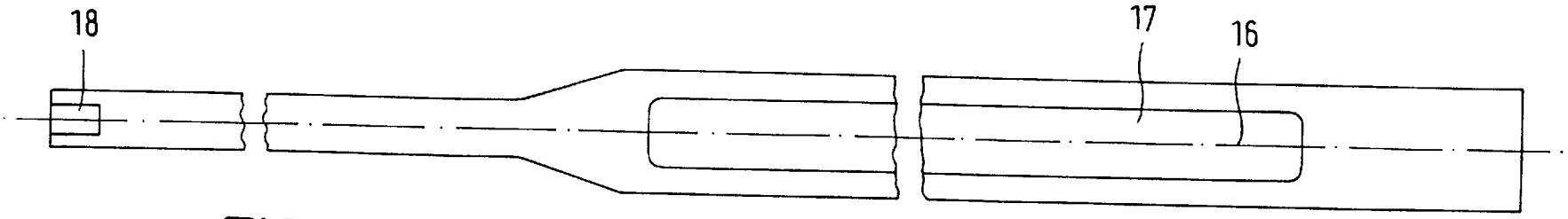
FIG. 3 shows the unwinding of the loop-shaped conductor segment illustrated in FIG. 2.

FIGS. 2 and 3 illustrate an additional particularly advantageous embodiment of a loop-shaped conductor segment 13 which consists of two turns 14, 15. In this embodiment, the first turn 14 of the conductor segment 13 has a central recess 17, which central recess 17 extends in the direction of the longitudinal axis 16 of the conductor segment 13. The second turn 15 is located in a space-saving manner inside this central recess 17. In this embodiment, the terminal portion of the second turn is also located in the immediate vicinity of the contact arm (not shown), so that the electrodynamic magnetic forces which are acting on the contact arm are particularly high, which leads to a very rapid opening of the contacts in the event of a short circuit current.

In an embodiment of the present invention, there can be a contact 18, at which point the circuit can break in the event of a short circuit current.

FIG. 3 illustrates the conductor as it would appear if it were unwound instead of looped. The central recess 17 is disposed about the central axis 16 and is large enough to receive the end on which the contact 18 is disposed.

The present invention is not limited to the exemplary embodiments described above. For example, it is possible in particular to use loop-shaped conductor segments which have more than two turns. The contact arm need not necessarily be realized in the form of a pivoting single-break contact element, but it can also be, among other things, a double-break contact element, which double break contact element is realized either in the form of a pivoting or translatory movement contact breaker.

One feature of the invention resides broadly in the switch which has at least one fixed and one moving contact 2, 4; 18 located on a contact arm 3, whereby the fixed contact 2; 18 is connected to a loop-shaped conductor segment 8; 13, such that when current flows through the conductor segment 8; 13, there is an electrodynamic magnetic force which acts on the contact arm 3, which force, above a specified current intensity, results in an opening movement of the contact arm 3 against the force of a contact compression spring, characterized by the fact that the loop-shaped conductor segment 8; 13 is realized so that it is wound in a coil shape, and consists of at least two turns 9, 10; 14, 15, and that the coil axis 8' of the coil segment 8; 13 runs perpendicular to the longitudinal axis of the contact arm 3.

Another feature of the invention resides broadly in the switch characterized by the fact that the first turn 14 of the loop-shaped conductor segment 13 has a central recess 17 which extends in the direction of the longitudinal axis 16 of the conductor segment 13, inside which recess 17 the second turn 15 is located.

Yet another feature of the invention resides broadly in the switch characterized by the fact that the loop-shaped conductor 8 consists of at least two turns 9, 10 which lie in a cross sectional plane, whereby the fixed contact 2 projects through a recess 8" in the respective first turn 9.

The components disclosed in the various publications, disclosed or incorporated by reference herein, may be used in the embodiments of the present invention, as well as, equivalents thereof.

The following U.S. Patents in which embodiments of the present invention may be incorporated, namely: U.S. Pat. No. 5,101,080, entitled "Busbar for Current Distributor Rails, Switchgear and the Like" to Boros; U.S. Pat. No. 5,176,529, entitled "Device for Connecting Control Current Lines" to Heinz and Winkler; U.S. Pat. No. 5,222,910, entitled "Plug Element for and Electrical Connection, in Particular, in Distribution Boards or Similar Installations" to Boros and Haar; U.S. Pat. No. 5,322,444, entitled "Device For the Electrical Connection of Parallel Busbars" to Audehm and Ammann; U.S. Pat. No. 5,362,933, entitled "Electrical Switching Devices, in Particular Low Voltage Power Circuit Breakers" to Kutsch, Kremers, Baldewein, Hentschel and Voiss; U.S. Pat. No. 5,369,384, entitled "Power Circuit Breaker with a Breaker Mechanism & A Breaker Mechanism for a Power Circuit Breaker" to Heins; U.S. Pat. No. 5,483,212, entitled "Overload Relay to be Combined with Contactors" to Lankuttis and Rossmann; U.S. Pat. No. 5,510,761, entitled "Contact System for a Current Limiting Unit" to Boder and Howald; U.S. Pat. No. 5,534,674, entitled "Current Limiting Contact System for Circuit Breakers" to Stephens; U.S. Pat No. 5,543,595, entitled "A Circuit Breaker with a Blocking Mechanism & A Blocking Mechanism for a Circuit Breaker" to Mader and Arenz; U.S. Pat. No. 5,614,888, entitled "Circuit Breaker with an Alarm Device & A Circuit for Generating an Alarm in a Circuit Breaker" to Borchmann and Bungartz; U.S. Pat. No. 5,539,168, entitled "Power Circuit Breaker Having a Housing Structure with Accessory Equipment for the Power Circuit Breaker" to Linzenich; and U.S. Pat. No. 5,650,902, entitled "Substation for the Distribution of Electrical Energy Protected Against Arcing Faults" to Herkenrath, Wey, Boros, Stade and Schau; and the references cited in all of the documents cited herein, are hereby incorporated by reference as it set forth in their entirety herein.

The following U.S. Patent applications in which embodimients of the present invention may be incorporated, namely: Ser. No. 08/577,126, entitled "Method and Device for Preparing Cable for Separating into Portions", filed on Dec. 22, 1995, and having the inventors Wolfgang Seidler, Hans Willi Muller and Gerhard Dargel; Ser. No. 08/628,258, entitled "Mechanical Switching Device such as a Circuit Breaker and a Safety Device for the Circuit Breaker", filed on Apr. 5, 1996, and having the inventor Kurt Hanidler; Ser. No. 08/687,581, entitled "Low Voltage Power Circuit Breaker with Relative Auxiliary Control Switch", filed on Aug. 8, 1996, and having the inventors Uwe Linzenich, Andreas Baldewein, Bernd Howald and Volker Heins; Ser. No. 08/734,628, entitled "Electrical Switching Device with Blow-Out Channels for Arc Gases", filed on Oct. 18, 1996, and having the inventors Christoph Bausch, Franz Boder and Bern Howald; Ser. No. 08/848,081, entitled "power Circuit Breaker with a Breaker Mechanism and a Breaker Mechanism for a Power Circuit Breaker with a Lock for a Low-Voltage Switch", filed on May 29, 1997, and having the inventors Volker Heins and Bogdan Zabrocki; Ser. No. 08/939,903, entitled "Electric Power Distribution Switching Device and an Accidental Arc Detector for an Electric Power Distribution switching Device", filed on Sep. 29, 1997, and having the inventors Andreas Schumacher and Ferenc Boros; Ser. No. 08/938,543, entitled "Low Voltage Switchgear Assembly for the Output or Distribution of Electrical Energy", filed on Sep. 26, 1997, and having the inventor Johannes Winkler; and Ser. No. 08/956,517, entitled "A Circuit Breaker or Contact System with a Multi-Range Power supply Unit and a Multi-Range Power Supply Unit", filed on Oct. 23, 1997, and having the inventors Albert Zacharias and Wolfgang Erven; and the references cited in all of the documents cited herein, are hereby incorporated by reference as if set forth in their entirety herein.

The following U.S. Patents may include breakers and electrical contacts for breakers, in which embodiments of the present invention may be incorporated: U.S. Pat. No. 5,384,678; U.S. Pat. No. 5,392,380; U.S. Pat. No. 5,416,287; U.S. Pat. No. 5,420,561; U.S. Pat. No. 5,424,699; U.S. Pat. No. 5,424,701; U.S. Pat. No. 5,428,195; U.S. Pat. No. 5,430,599; U.S. Pat. No. 5,434,369; U.S. Pat. No. 5,438,309; U.S. Pat. No. 5,439,396; U.S. Pat. No. 5,440,088; U.S. Pat. No. 5,440,284; U.S. Pat. No. 5,449,871; U.S. Pat. No. 5,452,170; U.S. Pat. No. 5,453,591; U.S. Pat. No. 5,459,444; U.S. Pat. No. 5,459,446; U.S. Pat. No. 5,463,199; and U.S. Pat. No. 5,479,143.

The appended drawings in their entirety, including all dimensions, proportions and/or shapes in at least one embodiment of the invention, axe accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 197 00 758.9, filed on Jan. 11, 1997, having inventors Albert Zacharias and Wolfgang Erven, and DE-OS 197 00 758.9 and DE-PS 197 00 758.9, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A switch for an electrical circuit breaker, the switch comprising at least one fixed contact and a moving contact located on a contact arm, the at least one fixed contact is connected to a loop-shaped conductor segment, such that when current flows through the conductor segment, there is an electrodynamic magnetic force which acts on the contact arm, which force, above a specified current intensity, results in an opening movement of the contact arm against the force of a contact compression spring, the loop-shaped conductor segment comprising a coil shape, said coil shape comprising at least a first turn and a second turn, said first turn being disposed substantially about said second turn, and that the coil axis of the coil segment runs perpendicular to the longitudinal axis of the contact arm.

2. Switch as claimed in claim 1, wherein the first turn of the loop-shaped conductor segment has a central recess, the central recess being disposed at least in the first turn and extending in the direction of the longitudinal axis of the conductor segment, inside which recess the second turn is located.

3. Switch as claimed in claim 1, wherein the at least a first turn and a second turn lie in a cross sectional plane, the first turn comprising a recess, the at least one fixed contact projecting through the recess in the first turn.

4. Switch which comprises at least one fixed and one moving contact located on a contact arm, wherein the fixed contact is connected to a loop-shaped conductor, such that when current flows through the loop-shaped conductor, there is an electrodynamic magnetic force which acts on the contact arm, which force, above a specified current intensity, results in an opening movement of the contact arm against the force of a contact compression spring, characterized by the fact that the loop-shaped conductor segment is realized so that it is wound in a coil shape, and comprises at least a first turn and a second turn, and that the coil axis of the coil runs perpendicular to the longitudinal axis of the contact arm.

5. Switch as claimed in claim 4, characterized by the fact that the first turn of the loop-shaped conductor segment has a central recess, said central recess being disposed at least in the first turn and extending in the direction of the longitudinal axis of the conductor segment, inside which recess the second turn is located.

6. Switch as claimed in claim 4, wherein the at least two turns lie in a cross sectional plane, the first turn comprising a recess and, the fixed contact projects through the recess in the respective first turn.

* * * * *

UNITED STATES PATENT AND TRADEMARK OFFICE

CERTIFICATE OF CORRECTION

PATENT NO. : 5,898,148

DATED : April 27, 1999

INVENTOR(S) : Albert ZACHARIAS and Wolfgang ERVEN

It is certified that error appears in the above-indentified patent and that said Letters Patent is hereby corrected as shown below:

In column 4, line 18, after 'Kurt', delete "Hanidler;" and insert --Handler;--.

In column 4, line 59, after 'invention,', delete "axe" and insert --are--.

Signed and Sealed this

Twenty-first Day of December, 1999

*Attest:*

Q. TODD DICKINSON

*Attesting Officer*

*Acting Commissioner of Patents and Trademarks*